US006242724B1

(12) United States Patent
Lee

(10) Patent No.: US 6,242,724 B1
(45) Date of Patent: Jun. 5, 2001

(54) MICROWAVE OVEN

(75) Inventor: Chea-how Lee, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/476,791

(22) Filed: Dec. 30, 1999

(30) Foreign Application Priority Data

Jan. 21, 1999 (KR) ..... P99-1810

(51) Int. Cl.[7] ..... H05B 6/64
(52) U.S. Cl. ..... 219/756; 219/763; 219/752
(58) Field of Search ..... 219/756, 752, 219/763, 521, 754, 755; 126/340, 339; 312/236; 99/DIG. 14

(56) References Cited

U.S. PATENT DOCUMENTS 4,880,952 * 11/1989 Hirai et al. ..... 219/685
5,338,922 * 8/1994 Kim et al. ..... 219/763
5,550,356 * 8/1996 Tripp et al. ..... 219/734
5,726,428 * 3/1998 Christensen ..... 219/754
5,796,082 * 8/1998 Kim ..... 219/752
5,818,017 * 10/1998 Ye et al. ..... 219/756
6,040,564 * 3/2000 Ueda et al. ..... 219/682

* cited by examiner

*Primary Examiner*—Teresa Walberg
*Assistant Examiner*—Jeffrey Pwu
(74) *Attorney, Agent, or Firm*—Robert E. Bushnell, Esq.

(57) ABSTRACT

A microwave oven capable of selectively adjusting capacity of a cooking chamber of a microwave oven, including a case; a body formed by front and rear panels which are arranged in front/back of the case, the body having a cooking chamber having a first cavity concaved from an upper side of the cooking chamber and a second cavity; and an adjustable section for selectively adjusting the capacity of the cooking chamber by selectively blocking the first and second cavities by being selectively coupled in the body.

6 Claims, 4 Drawing Sheets

MICROWAVE OVEN

CLAIM OF PRIORITY

This application makes reference to, incorporates the same herein, and claims all benefits accruing under 35 U.S.C. §119 from my application MICROWAVE OVEN filed with the Korean Industrial Property Office on Jan. 21, 1999 and there duly assigned Ser. No. 1810/1999.

BACKGROUND OF THE INVENTION

1. Field of the Invention

The present invention relates to a microwave oven, and more particularly to a microwave oven capable of selectively adjusting a capacity of a cooking chamber which is defined within an integrally formed case of the microwave oven.

2. Description of the Prior Art

Generally, a microwave oven is a device for cooking food by using microwaves. The microwaves are generated by a magnetron, and are radiated into the food to collide the molecules in the food so that frictional heat is generated to cook the food. There are various types of microwave ovens, and one example is shown in FIG. 1.

As shown in FIG. 1, the microwave oven includes a body 10 having a box-shaped case 11, and front and rear panels 12 and 13 which are arranged in front and back of the case 11, respectively. In the case 11, a cooking chamber 30 is formed to receive the food to be cooked, and the cooking chamber 30 is opened/closed by a door 20 which is pivotally mounted on one side of the front panel 12.

Meanwhile, as shown in FIG. 2A, the cooking chamber 30 formed within the case 11 has a rather sufficient capacity due to the existence of a first cavity 31 which is concaved from an upper side of the case 11, and a second cavity 32 which is communicated with the first cavity 31.

Then, when manufacturing the microwave oven having the cooking chamber of a reduced capacity, the case 11 is integrally formed in a manner that the space defined by the first cavity 31 is removed, while the space defined by the second cavity 32 remains. Such is shown in FIG. 2B.

Further, the microwave oven includes a device chamber 40 which is defined at an inner side of the microwave oven. In the device chamber 40, electric components such as a magnetron (not shown) for generating high frequency microwaves, a high voltage transformer 41 for transmitting high voltage to the magnetron, and a high voltage capacitor 42, etc., and other components such as a fan motor 43 for cooling the heat generated from the respective electric components, etc., are installed. The device chamber 40 is enclosed by an outer panel 50.

Further, in front of the device chamber 40, a control panel 60 is formed on the front panel 12, having a plurality of function buttons for inputting user's commands about cooking functions and operation execution, etc.

In the microwave oven constructed as above, the cooking operation begins as the user places the receptacle holding the food to be cooked on a tray in the cooking chamber 30, and manipulates the function buttons on the control panel 60. As the cooking operation begins, the microwaves are generated from the magnetron (not shown) in the device chamber 40, and are radiated into the food through certain processes, to heat/cook the food.

The conventional microwave oven, however, has a shortcoming particularly when manufacturing the case for defining the cooking chamber as follows:

As shown in FIG. 2A, when manufacturing the cooking chamber 30 with sufficiently large capacity, the second cavity 32 is communicated with the first cavity 31 which is concaved from the upper side of the case 11. Meanwhile, when manufacturing the cooking chamber 30 with a reduced capacity, the second cavity 31 is removed, and the case 11 is integrally formed as shown in FIG. 2B.

Accordingly, an additional cost is required for molding the case, and the manufacturing cost increases.

SUMMARY OF THE INVENTION

The present invention has been developed to overcome the above-described problems of the prior art, and accordingly, it is an object of the present invention to provide a microwave oven capable of selectively adjusting capacities thereof by an adjustable member without having to manufacture cases for the respective capacities.

The above object is accomplished by a microwave oven including: a case; a body formed by front and rear panels which are arranged in front/back of the case, the body having a cooking chamber having a first cavity concaved from an upper side of the cooking chamber and a second cavity; and adjustable section for selectively adjusting capacities of the cooking chamber by selectively blocking the first and second cavities by being selectively coupled in the body.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
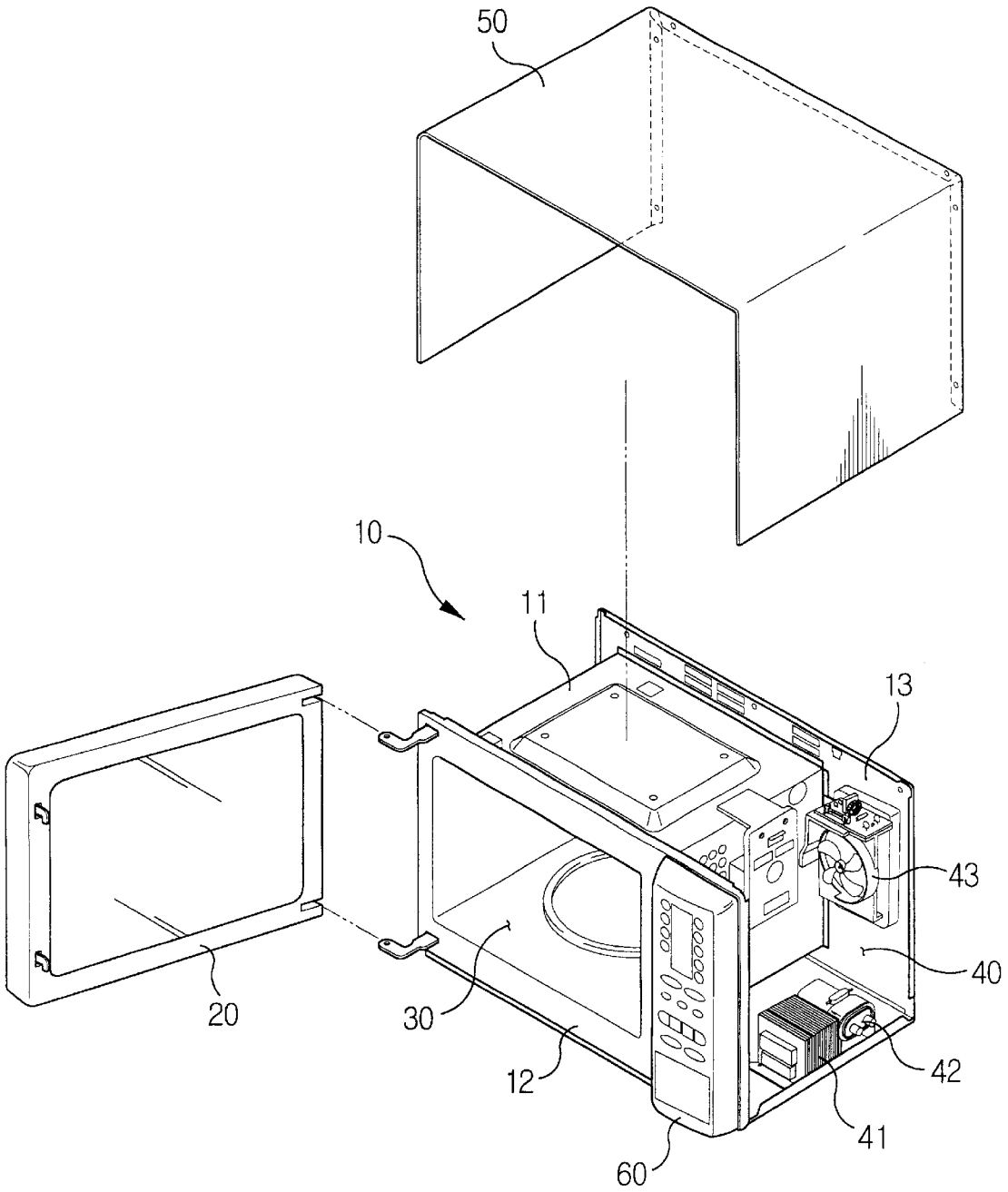
FIG. 1 (PRIOR ART)
FIG. 1 is an exploded perspective view of a conventional microwave oven.
Figure 2A:
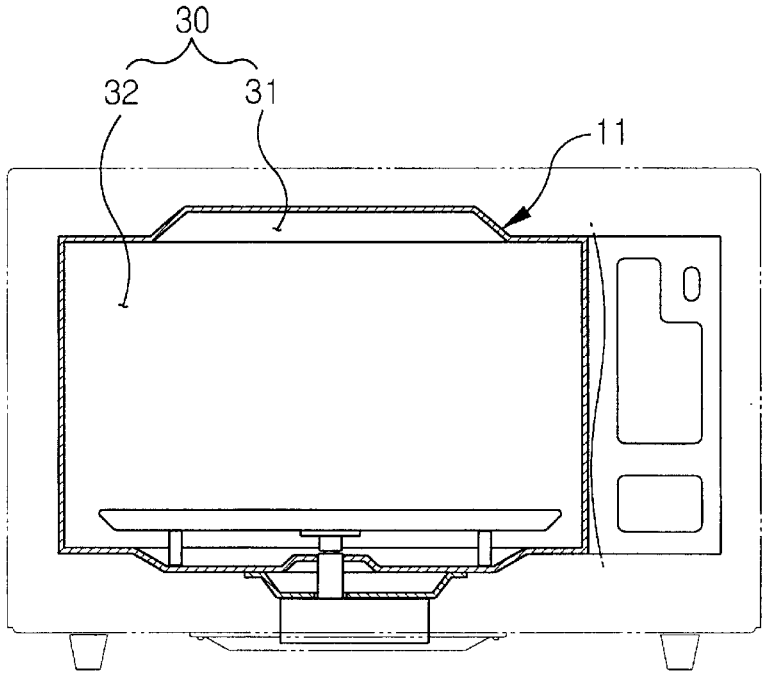
FIG.2A (PRIOR ART)
FIGS. 2A and 2B are sectional views of the conventional microwave oven having cooking chambers of different capacities, respectively.
Figure 2B:
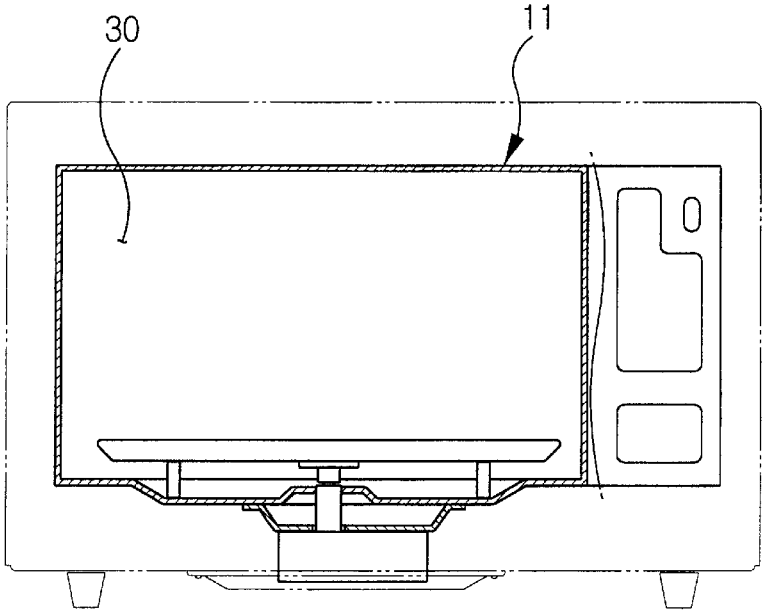
FIG.2B (PRIOR ART)

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Figure 3:
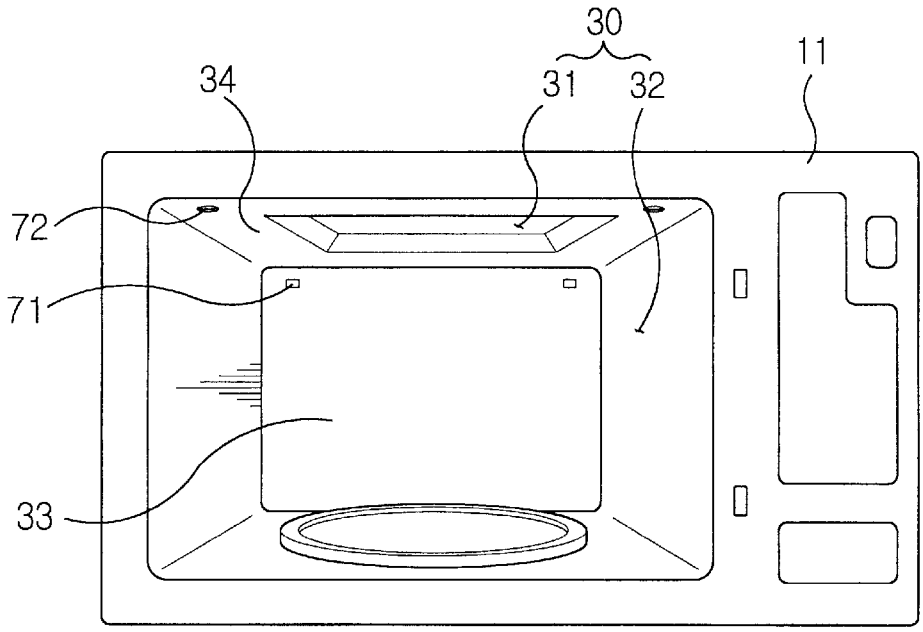
FIG. 3 is a front perspective view of a microwave oven showing the inner structure of the cooking chamber of the microwave oven according to the present invention.
Figure 4:
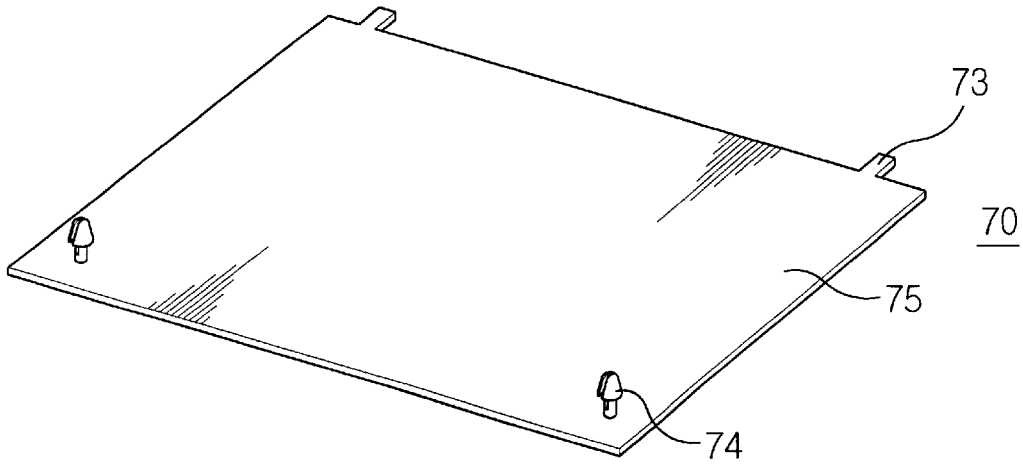
FIG. 4 is a perspective view of an adjustable plate employed to adjust the capacities of the cooking chamber of the microwave oven according to the present invention.
Figure 5:
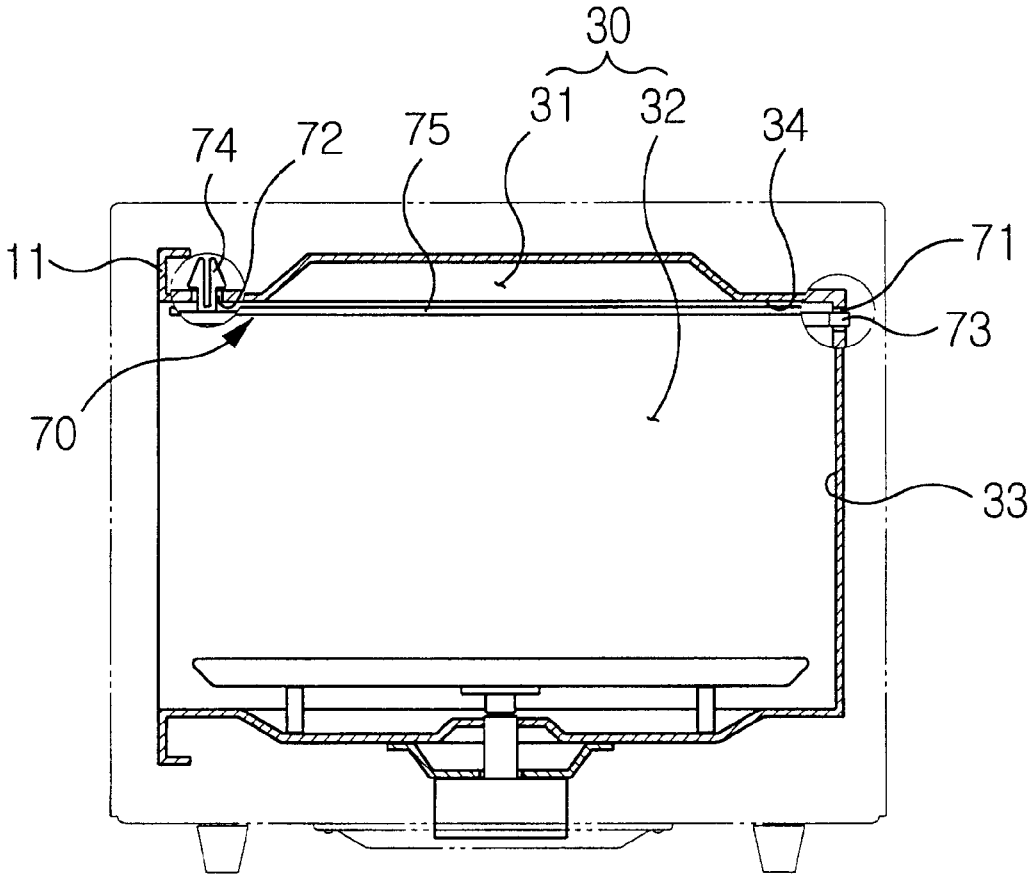
FIG. 5 is a sectional view of the microwave oven having a reduced capacity by the adjustable plate shown in FIG. 4 according to the preferred embodiment of the present invention.

FIG. 3 is a front perspective view of a microwave oven showing the inner structure of the cooking chamber of the microwave oven according to the present invention, and FIG. 4 is a perspective view of an adjustable plate employed to adjust the capacities of the cooking chamber of the microwave oven according to the present invention.

The microwave oven according to the present invention includes a box-shaped case 11. A cooking chamber 30 is formed within the case 11. The cooking chamber is defined by a first cavity 31 concaved from an upper side of the cooking chamber 30, and a second cavity 32.

Further, the cooking chamber 30 has an adjustable section 70 for adjusting the capacities of the cooking chamber 30 by blocking the first cavity 31 from the second cavity 32.

Here, the adjustable section 70 is made of a rectangular adjustable plate 75 of a certain thickness which has substantially the same width as the second cavity 32. The adjustable plate 75 includes a pair of coupling protrusions 73 protruded from a rear side, and a pair of locking protrusions 74 protruded from the upper surface of the adjustable plate 75 at the front side portion of the adjustable plate 75.

Meanwhile, the second cavity 32 has a pair of coupling holes 71 formed on a rear wall 33 thereof, to receive the pair of coupling protrusions formed on the rear side of the adjustable plate 75. Further, the second cavity 32 includes a pair of locking holes 72 formed on an upper wall 34 thereof, to receive the pair of locking protrusions 74 protruded from the upper surface of the adjustable plate 75 at the front side portion thereof.

Here, the pair of coupling protrusions 73 are supported just by being inserted in the coupling holes 71. The pair of locking protrusions 74, however, are forcibly inserted in the pair of locking holes 72, and accordingly, it is preferable that the pair of locking protrusions 74 are made of wedge-shaped hook members which have a certain elasticity.

Although it is depicted as the coupling and locking protrusions 73 and 74 are formed in pairs on the adjustable plate 75, and the coupling and locking holes 71 and 72 are formed in pairs on the second cavity 32, the number of coupling and locking protrusions and holes 73, 74 and 71, 72 can be increased for a greater degree of coupling with the adjustable plate 75.

Also, it is more preferable that the adjustable plate 75 is made of a permeable synthetic resin such as a polypropylene and mica sheet, etc., for permitting an efficient permeation of the microwaves from the magnetron therethrough. At the same time, however, it is also possible that the adjustable plate 75 is made of the same metallic plate as the upper wall 34 of the cooking chamber 30.

Since the operation of the subject microwave oven constructed as above is the same as the operation of the conventional microwave oven, a repetitious description thereof will be omitted, but attention is invited to the unique features of the present invention.

First, when manufacturing the case 11 of the subject microwave oven, the second cavity 32 and the first cavity 31 concaved from the second cavity 32 and communicated with the second cavity 32 are made in a manner that the first and second cavities 31 and 32 integrally form the case 11.

A pair of coupling holes 71 are formed on the upper side of the rear wall 33 of the second cavity 32, and a pair of locking holes 72 are formed on the front side of the upper wall 34.

Next, the rectangular adjustable plate 75 of a certain thickness having substantially the same width as the second cavity 32 is made. Here, a pair of coupling protrusions 73 are protruded from the rear side of the adjustable plate 75 to correspond with the pair of coupling holes 71 formed on the second cavity 32. Further, on the front side of the adjustable plate 75, a pair of locking protrusions 74 are protruded to correspond with the pair of locking holes 72 of the second cavity 32.

Accordingly, when manufacturing the microwave oven having the case 11 with a sufficiently large capacity, the microwave oven is forwarded for shipment without employing the adjustable plate 75 therein, in an initial state in which the first and second cavities 31 and 32 integrally form the case 11 by being communicated with each other.

Then, when manufacturing the microwave oven having the case 11 with reduced capacity, the adjustable plate 75 is employed in the cooking chamber 30 as the coupling protrusions 73 of the adjustable plate 75 are coupled with the coupling holes 71 of the second cavity 32, and the locking protrusions 74 are locked in the locking holes 72 of the second cavity 32. Accordingly, the first cavity 31 is sealed from the second cavity 32.

As a result of employing the adjustable plate 75 in the microwave oven, the capacity of the cooking chamber 30 is decreased, so that the microwave oven having available space within the second cavity 32 only is mass-produced.

Accordingly, by integrally forming the case 11 with the first and second cavities 31 and 32, and by selectively attaching or detaching the adjustable plate 75 in or from the case 11, the capacity of the cooking chamber 30 is easily adjusted.

As described above, according to the present invention, the case 11 defining the cooking chamber 30 of the microwave oven is integrally formed, while the capacity thereof is selectively adjustable. Accordingly, an additional cost for molding the case is reduced, and the total manufacturing cost is decreased.

Although it is depicted that the capacity of the case 11 of the microwave oven is adjusted by the adjustable plate 75, which is selectively attached or detached in or from the case during the manufacturing process in the present invention, such is not limited thereto only, but can have modifications such as enabling a user to adjust the capacity of the cooking chamber 30 by himself/herself with the adjustable plate 75 which can be distributed along with the microwave oven, or the like.

Further, although it is depicted that the first cavity 31 is formed on the upper wall of the cooling chamber 30, such is also not limited thereto, but can have modifications such as the first cavity 31 is formed on the rear wall of the cooking chamber 30, or the like.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven comprising:

a case;

a body formed by front and rear panels which are arranged in front/back of the case, the body having a cooking chamber having a first cavity concaved from an upper side of the cooking chamber, and a second cavity; and adjustable means for selectively adjusting a capacity of the cooking chamber by selectively blocking the first cavity from the second cavity by being selectively attached in the body.

2. The microwave oven as claimed in claim 1, wherein the adjustable means is comprised of a rectangular plate member.

3. The microwave oven as claimed in any of claims 1 and 2, wherein the adjustable means comprises:

a plurality of coupling protrusions protruded from a rear side thereof; and a plurality of locking protrusions protruded from an upper surface of the adjustable means at a front side thereof, and the body comprises:

a plurality of coupling holes formed on a rear wall of the second cavity to receive the plurality of coupling protrusions of the adjustable means, and a plurality of locking holes formed on an upper wall of the second cavity to receive the plurality of locking protrusions of the adjustable means.

4. The microwave oven as claimed in claim 3, wherein the plurality of coupling protrusions are supported simply by being inserted into the coupling holes of the second cavity, and the plurality of locking protrusions are formed of hook members having a certain elasticity to be forcibly inserted in the plurality of locking holes of the second cavity, respectively.

5. The microwave oven as claimed in claim 1, wherein the adjustable means is comprised of permeable synthetic resins which permit microwaves to pass therethrough.

6. The microwave oven as claimed in claim 1, wherein the adjustable means is comprised of a metallic plate.

* * * * *